United States Patent [19]

Bakul et al.

[11] 4,164,527

[45] Aug. 14, 1979

[54] METHOD OF MAKING SUPERHARD ARTICLES

[76] Inventors: Valentin N. Bakul, ulitsa Kirova, 34a, kv. 12; Ivan F. Vovchanovsky, Bulvar Lesi Ukrainki, 5, kv. 119; Nekhemian V. Tsypin, ulitsa Dorogozhitskaya, 26, kv. 59, all of Kiev, U.S.S.R.

[21] Appl. No.: 714,684

[22] Filed: Aug. 16, 1976

Related U.S. Application Data

[63] Continuation of Ser. No. 612,921, Sep. 12, 1975, abandoned, which is a continuation of Ser. No. 520,212, Nov. 1, 1974, abandoned.

[51] Int. Cl.[2] ..... C04B 35/52

[52] U.S. Cl. ..... 264/60; 51/309; 264/325; 264/332

[58] Field of Search ..... 51/309; 264/60, 332, 264/275, 271, 325

[56] References Cited

U.S. PATENT DOCUMENTS

| | | | |
|---|---|---|---|
| 3,720,740 | 3/1973 | Moto et al. | 264/332 |
| 3,871,840 | 3/1975 | Wilder et al. | 51/309 |

*Primary Examiner*—Robert F. White
*Assistant Examiner*—John A. Parrish
*Attorney, Agent, or Firm*—Holman & Stern

[57] ABSTRACT

The method of preparing superhard articles consists of placing a mixture of powdered hard-alloy matrix material and diamond grains into a hard-alloy envelope formed from a hard-alloy material, preferably of exactly the same composition as the hard-alloy matrix material of the mixture, with the thickness of the hard-alloy envelope over the entire area thereof exceeding by at least 3–4 times the maximum space between any two adjacent diamond grains within the mixture. The mixture in the envelope is then subjected to sintering in a free condition thereof, without any external mechanical loads being applied thereto.

4 Claims, 5 Drawing Figures

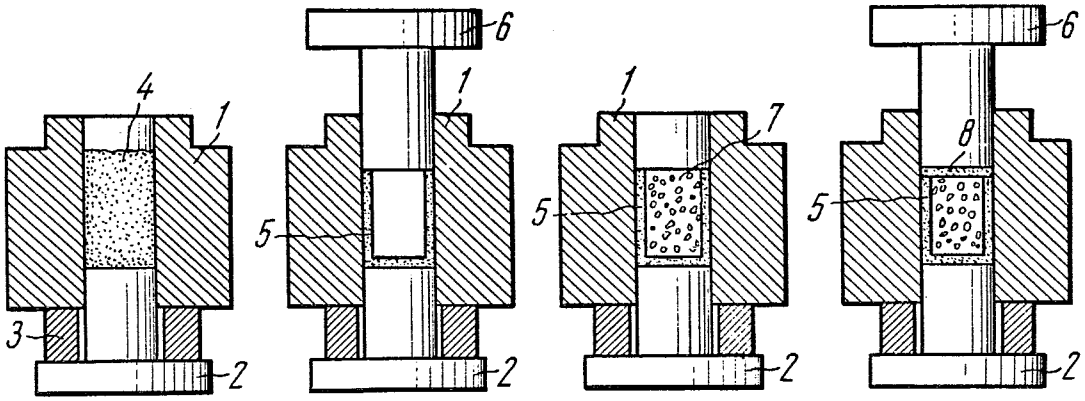
FIG. 1
FIG. 2
FIG. 3
FIG. 4
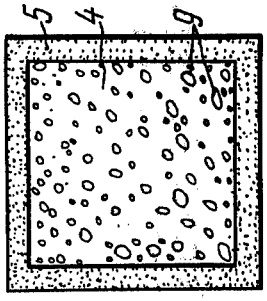
FIG. 5

METHOD OF MAKING SUPERHARD ARTICLES

This is a continuation of application Ser. No. 612,921, filed Sept. 12, 1975 which in turn is a continuation of Ser. No. 520,212 filed Nov. 1, 1974, both of which are now abandoned.

BACKGROUND OF THE INVENTION

The present invention relates to methods of preparing an article including a superhard component such as diamond or borazone and a metalloceramic matrix material.

Known in the prior art are methods of preparing articles from a superhard diamond-containing material by hot pressing thereof.

In accordance with these methods, it is necessary to prepare special graphite press-moulds which are generally used only once. The articles after sintering are covered with graphite and, hence require additional treatment. A great disadvantage of these prior art methods resides in the fact that the articles become saturated with carbon contained in the press-mould, which is in many cases impermissible.

Widely known is a method of "free sintering" of metalloceramic articles, which method is free of the aforementioned disadvantage, since the application of a graphite press-mould is not necessary. The articles have a high quality surface finish, thus making it possible to use these articles for tooling without any additional processing.

The foregoing method of free sintering, however, is practically unacceptable for preparing diamond-containing articles due to the fact that in the course of shrinkage of the powdered matrix material around the incompressible diamond grains, cracking of the sintered composition takes place.

By the term "free sintering" we mean the process of shrinkage of a metalloceramic article which occurs as a result of heating the article formed from a powdered material and disposed in free conditions without any press-mould, i.e., the pressed article is disposed on a fire-proof base or a refractory powder layer such as for instance, alumina.

Thus, during such a sintering process the article is not subjected to any external loads which usually result from the mechanical action of the press upon the plunger of the press-mould, as in the case of hot "non-free" pressing.

SUMMARY OF THE INVENTION

An object of the present invention, therefore, is to provide a method of making superhard articles which excludes undesirable graphitization of diamonds contained within the sintered composition.

Another object of the present invention is to provide a method of making superhard articles by a free sintering process without any non-uniform contraction of the sintered mass and without the danger of cracking the article formed upon completion of the process.

Among other objects of the present invention is to provide a method having positive features and not requiring a complicated and expensive technology for practicing the method, as compared with the prior art methods.

These and other objects are achieved, in accordance with the present invention, in a method of making superhard articles from a homogeneous mixture of a powdered hard-alloy matrix material and diamond grains by sintering a briquette of the mixture, the briquette being free of any external mechanical loads, wherein the briquette of the hard-alloy matrix containing diamond grains uniformly distributed therein is provided with an external envelope formed from the same powdered hard-alloy matrix material having a thickness throughout the entire area thereof exceeding by at least 3–4 times the maximum space between any two adjacent diamond grains within the briquette. The briquette surrounded by the envelope is then sintered in the free condition, whereby the envelope having a relatively higher contraction coefficient compresses the mixture disposed therein.

Such a technical solution eliminates any danger of graphitization of the diamonds in the mixture by increasing the rate of the process and also avoids non-uniform shrinkage of the composition, which in the present case is compressed by the outer envelope in the course of sintering.

Moreover the method of making superhard articles, according to the present invention, is characterized in that the envelope is made of the same material as that of the hard-alloy matrix material of the briquette.

The foregoing embodiment of the invention makes it possible to carry out the proposed method in a simpler and more efficient way to achieve superior results.

Moreover in the method of making superhard articles, in accordance with the present invention, a shell of the hard-alloy envelope is previously formed and then the shell is filled with a briquette of the hard-alloy matrix material containing the diamond grains. The shell is closed by an end layer to complete thereby the hard-alloy envelope all around the briquette and then the briquette in the complete envelope is subjected to sintering by a conventional process.

Such proposed technology makes it possible to effect optimal realization of the invented method of free sintering of the initial composition in a hard-alloy envelope.

BRIEF DESCRIPTION OF THE DRAWINGS

The present invention will be better understood from the following description of its exemplary embodiment with reference to the accompanying drawings, wherein:

FIG. 1 illustrates a metallic press-mould with a hard-alloy matrix material contained therein required to form an envelope around the briquette being sintered;

FIG. 2 shows the step of pressing a hard-alloy matrix material envelope by means of a plunger;

FIG. 3 shows the arrangement of the briquette contained in the envelope;

FIG. 4 illustrates the step of press-shaping an article after the top layer of the hard-alloy matrix material has been provided and the plunger is set into position; and FIG. 5 shows a sectional view of a shaped article, before the free sintering thereof, wherein the envelope made of the hard-alloy matrix material surrounds the briquette of the same hard-alloy matrix material but containing diamond grains.

DETAILED DESCRIPTION OF THE PREFERRED EMBODIMENT

The realization of the method of making superhard articles may be explained by the following example of manufacturing an insert with a diameter of 10 mm and a height of 10 mm for reinforcing a dressing tool. The starting material is a hard-alloy matrix material of WC—Co (e.g. an alloy containing 94% of tungsten carbide and 6% of cobalt). The insert is shaped in a metallic press-mould which can be used many times.

The press-mould is composed of a die 1 (FIG. 1), a lower plunger 2 and a yoke-like support 3. Initially a hard-alloy matrix material 4 is placed onto the bottom of the chamber of the press-mould in an amount adequate for shaping a hard-alloy envelope 5 (FIG. 2).

The envelope 5 is then pressed by an upper plunger 6. Separately, a briquette 7 of superhard material is prepared. The briquette 7 consists of powdered hard-alloy matrix material of WC—Co and diamonds, taken in a ratio of 4:1 respectively. After the plunger 6 is extracted from the press-mould, the briquette 7 of the superhard material (hard-alloy matrix material and diamonds) is placed into the envelope 5. After that, the envelope is covered with a top layer 8 (FIG. 4) of the matrix material to form a closed shell, the plunger 6 is set into position and the article-insert is pressed.

Then the aforementioned free sintering of the composition is carried out. To this end, the shaped briquette under the hard-alloy envelope 5 is freely placed into alumina powder within a special graphite container currently used for sintering hard-alloy articles. Heating is carried out in a hydrogen furnace by pushing the container through the heating zone of the furnace. At a temperature of about 1400–1460° C. the hard-alloy mixture is sintered.

The hard-alloy envelope 5 surrounding the briquette has a higher contraction coefficient than that of the diamond-containing mixture 7 within the briquette, thus, in the course of sintering, the hard-alloy envelope 5 compresses the briquette providing thereby the forces for reventing the cracking of the sintered article.

It must be noted that the best results are obtained when the hard-alloy matrix material of the briquette has exactly the same composition as that of the hard-alloy envelope 5. The term "sintering" used herein is to be understood as the compacting of a heated composition compacted to a condition that the composition has a minimum or zero porosity.

FIG. 5 shows a composition shaped in a briquette form before free sintering thereof. Here, the hard-alloy envelope 5 not containing diamonds surrounding the briquette of hard-alloy mixture of matrix material 4 containing diamond grains 9 uniformly distributed throughout the volume thereof. The matrix material 4 of the briquette and the envelope 5 are made of exactly the same material. The envelope 5 has a thickness over the entire area thereof exceeding by not less than 3–4 times the maximum space between any two adjacent diamond grains 9 within the briquette. The article after sintering has a smooth surface. When it is necessary, the external layer may be removed. In the majority of cases, however, it is expedient to use the article together with the protective shell which makes the article more durable.

What we claim is:

1. A method of making a superhard article comprising the steps of: preparing a briquette from a homogeneous mixture of a powdered hard-alloy matrix material and diamond grains uniformly distributed throughout the matrix material; providing the briquette with an external envelope formed from the same powdered hard-alloy matrix material of the briquette and having a thickness over the entire area thereof exceeding by at least 3–4 times the maximum space between any two adjacent diamond grains within the briquette; and sintering the briquette in the envelope in a free condition without any external mechanical loads being applied to the briquette, whereby the envelope having a higher contraction coefficient than the briquette compresses the briquette.

2. The method according to claim 1, wherein the step of providing the briquette with the external envelope comprises: forming a shell made of the hard-alloy matrix material; filling the shell with the briquette; and covering the briquette with a top layer of the hard-alloy matrix material to complete thereby a hard-alloy envelope all around the briquette

3. The method according to claim 1 wherein the hard-alloy matrix material consists of tungsten carbide and cobalt.

4. The method according to claim 1 wherein the briquette consists of 80% of the powdered hard-alloy matrix material and 20% of the diamond grains.

* * * * *